US005272902A

United States Patent [19]

Kobak

[11] Patent Number: 5,272,902

[45] Date of Patent: Dec. 28, 1993

[54] DOMER ASSEMBLY FOR METAL CONTAINERS WITH NITROGEN PRESSURE SOURCE

[75] Inventor: Roger L. Kobak, Castlerock, Colo.

[73] Assignee: Preferred Machining Corporation, Englewood, Colo.

[21] Appl. No.: 847,016

[22] PCT Filed: Sep. 6, 1990

[86] PCT No.: PCT/US90/05055

§ 371 Date: Apr. 3, 1992

§ 102(e) Date: Apr. 3, 1992

[87] PCT Pub. No.: WO92/04143

PCT Pub. Date: Mar. 19, 1992

[51] Int. Cl.[5] ..... B21D 24/16

[52] U.S. Cl. ..... 72/348; 72/465

[58] Field of Search ..... 72/348, 350, 453.13, 72/465; 267/119

[56] References Cited

U.S. PATENT DOCUMENTS

| | | | |
|---|---|---|---|
| 3,760,751 | 9/1973 | Dunn et al. | 113/120 H |
| 4,571,978 | 2/1986 | Taube et al. | 72/349 |
| 4,620,434 | 11/1986 | Pakiano | 72/347 |
| 4,723,433 | 2/1988 | Grims | 72/354 |
| 4,774,865 | 10/1988 | Wallis | 83/128 |
| 4,790,169 | 12/1988 | Johansson et al. | 72/354 |
| 4,815,718 | 8/1989 | Kadis | 267/119 |
| 4,838,527 | 6/1989 | Holley | 267/64.28 |
| 4,930,330 | 6/1990 | Weishalla | 72/348 |
| 4,934,230 | 6/1990 | Wallis | 83/128 |
| 5,125,257 | 6/1992 | Worwag et al. | 72/348 |

*Primary Examiner*—Lowell A. Larson

*Attorney, Agent, or Firm*—John E. Reilly

[57] ABSTRACT

Doming apparatus for forming a domed bottom wall in a can body includes a pressurized nitrogen source which acts through a cylinder and piston arrangement to impose a predetermined amount of resistance to movement of a clamp ring and former die used in the doming procedure and wherein the nitrogen pressure source is a self-contained unit removably attached to the domer assembly and which can be serviced and replaced independently of the domer assembly.

15 Claims, 2 Drawing Sheets

DOMER ASSEMBLY FOR METAL CONTAINERS WITH NITROGEN PRESSURE SOURCE

This invention relates to can bottom forming apparatus; and more particularly relates to a novel and improved domer assembly and fluidized nitrogen pressure source therefor in bottom forming of a metal container.

BACKGROUND AND FIELD OF INVENTION

In metal can manufacturing operations, the bottom of the can is customarily formed with a domer assembly in which a ram-mounted metal can blank is forced in succession against a clamp ring and domer tool to form an outer peripheral beveled or radiused edge in surrounding relation to a domed portion. In doming operations, it is important to establish a differential between the reaction force for resisting movement of the clamp ring and that required for resisting movement of the dome forming tool. Initially, the force of the ram will overcome the reaction force of the clamp ring to cause the clamp ring to be retracted; and then will continue to force the bottom of the can against the domer tool to result in an upwardly dome-shaped configuration in the bottom wall of the can. "Overstroking" occurs as the ram completes its working stroke prior to its return stroke and is important in causing the ram to bottom out at the end of the stroke to complete formation of the dome in the bottom wall of the can.

In the past, reaction forces have been generated through the use of mechanical springs acting either alone or in combination with fluidized pressure sources, such as, airbags or air cylinders. Representative of such approaches are U.S. Pat. Nos. 4,790,160 to B. E. Johansson et al, 3,760,751 to L. G. Dunn et al, 4,620,434 to S. Pulciano et al, and 4,930,330 to G. Weishalla. Moreover, it has been proposed in the past to utilize nitrogen pressure sources in die-stamping operations and, for example, attention is directed to U.S. Pat. Nos. 4,774,865 and 4,934,230 to B. J. Wallis, 4,815,718 to P. M. Kadis and 4,838,527 to D. M. Holley. In addition, U.S. Pat. No. 4,715,978 to W. L. Taube et al proposes the use of a nitrogen pressure source in creating different force levels acting across a piston and piston rod in forming a can end or blank. As employed by Taube et al, nitrogen gas is proposed as merely one type of fluidic pressure source in a different type of forming operation than the doming operation of this invention but in which the pressure exerted across an outer forming ring is higher than that applied across an inner concentric forming pad; and the fluid pressure is utilized more to load a mechanical spring which in turn applies the force to a knock-out lift ring to remove the formed can end.

In doming operations, it is desirable to maintain present reaction forces cable of withstanding high speed repetitive stroking of a ram in doming each can bottom. However, the utilization of springs creates particular problems in maintaining a preset reaction force over repeated doming operations. The same is true of many of the fluidized pressure sources employed and particularly those which rely upon airbags or air cylinders and this problem is exacerbated by the difficulty of gaining access to the reaction force-generating means whether in the form of springs or fluidized pressure sources for the purpose of servicing or replacement. Typically, such generating means are mounted internally as a unitary part of the domer assembly and require disassembly of the entire installation for repair or replacement.

When overstroking is desired at the end of each working stroke, it is important that closer tolerances be established to assure that the overstroking will occur just as the ram bottoms out and prior to its return for the next working stroke; also, that there be a constant predetermined pressure when the ram or punch bottoms out. Under repeated doming operations, there is a tendency to lose the tolerances required as well as to experience pressure changes in generating the reaction forces needed for precise overstroking.

It is therefore desirable to provide for a domer assembly which is so constructed and arranged as not to require disassembly of the entire installation in order to replace or service the reaction force-generating means and specifically in such a way that the generating means can be attached independently to the domer assembly and automatically brought into alignment with the clamp ring and domer tool in performing doming operations. Furthermore, it is desirable to provide for such an installation in which the reaction forces are generated in an axial direction in direct opposition to and in alignment with the respective movement of the clamp ring and dome plug. Also, it is important that the domer assembly be readily adjustable for different length domer tools and to make any necessary adjustments in tolerances to achieve the overstroking required at the bottom or end of each working stroke.

SUMMARY OF THE INVENTION

It is therefore an object of the present invention to provide for a novel and improved apparatus for forming a dome in the bottom wall of a can body which is greatly simplified in construction and assembly and is highly efficient in operation.

Another object of the present invention is to provide in a domer assembly for a novel and improved fluidized pressure source which is removably attached as a self-contained unit after installation of the domer assembly and is readily accessible for servicing or replacement without disassembly of the entire apparatus.

It is a further object of the present invention to provide in a domer apparatus for a novel and improved nitrogen pressure source for generating differential forces to resist movement of a clamp ring and domer forming tool in can bottom forming operations whereby to permit initial forming along an outer peripheral edge or corner of the blank followed by internal doming at the center of the blank.

It is a further object of the present invention to provide in a domer apparatus for a novel and improved nitrogen pressure source for generating constant forces to resist movement of a clamp ring and dome forming tool throughout the entire cycle of movement required of the clamp ring and dome forming tool for forming a dome in the bottom wall of a can body.

It is an additional object of the present invention to provide in a domer apparatus for a fluid pressure source in which the force levels established in reaction to movement of the clamping ring and dome forming tool are independently adjustable to conform to the requirements of different sizes and types of can bottoms; and further wherein the domer assembly is readily disassembled independently of the pressure source for adjustment, servicing and repair.

In accordance with the present invention, a domer assembly has been devised for forming a bottom wall in a metal container wherein the domer assembly includes a dome former die, a clamp ring in outer concentric relation to the die and means supporting the die and clamp ring for independent axial slidable movement with respect to one another, a punch member supporting the container for movement of the bottom wall successively against the claim ring and former die, and the combination therewith of a fluidized pressure source, former die cylinder means engageable with the former die support means to yieldingly resist axial slidable movement of the former die, clamp ring cylinder means in other surrounding relation to the former die cylinder means to resist axial slidable movement of the clamp ring, and mounting means for attaching the fluidized pressure source, dome plug cylinder means and clamp ring cylinder means, all as a separate self-contained unit independently of the mounting of the domer assembly to an outer housing. In accomplishing the foregoing, the fluidized pressure source is preferably a nitrogen gas pressure source which maintains a constant pressure in a common manifold for the unit, and the cylinder means includes pistons bearing against push plates at the respective ends of the former die and clamp ring to yieldingly resist their axial slidable movement when the punch member is driven through each working stroke. The respective cross-sectional areas of the piston are selected to establish the amount of resistance to axial slidable movement of the former die and clamp ring, the abutting end surfaces between the pistons and push plates being in a common plane to simplify the manufacture, assembly and disassembly of the entire apparatus.

The above and other objects, advantages and features of the present invention will become more readily understood and appreciated from a consideration of the following detailed description of a preferred embodiment of the present invention when taken together with the accompanying drawings in which:

DETAILED DESCRIPTION OF A PREFERRED EMBODIMENT

Figure 1:
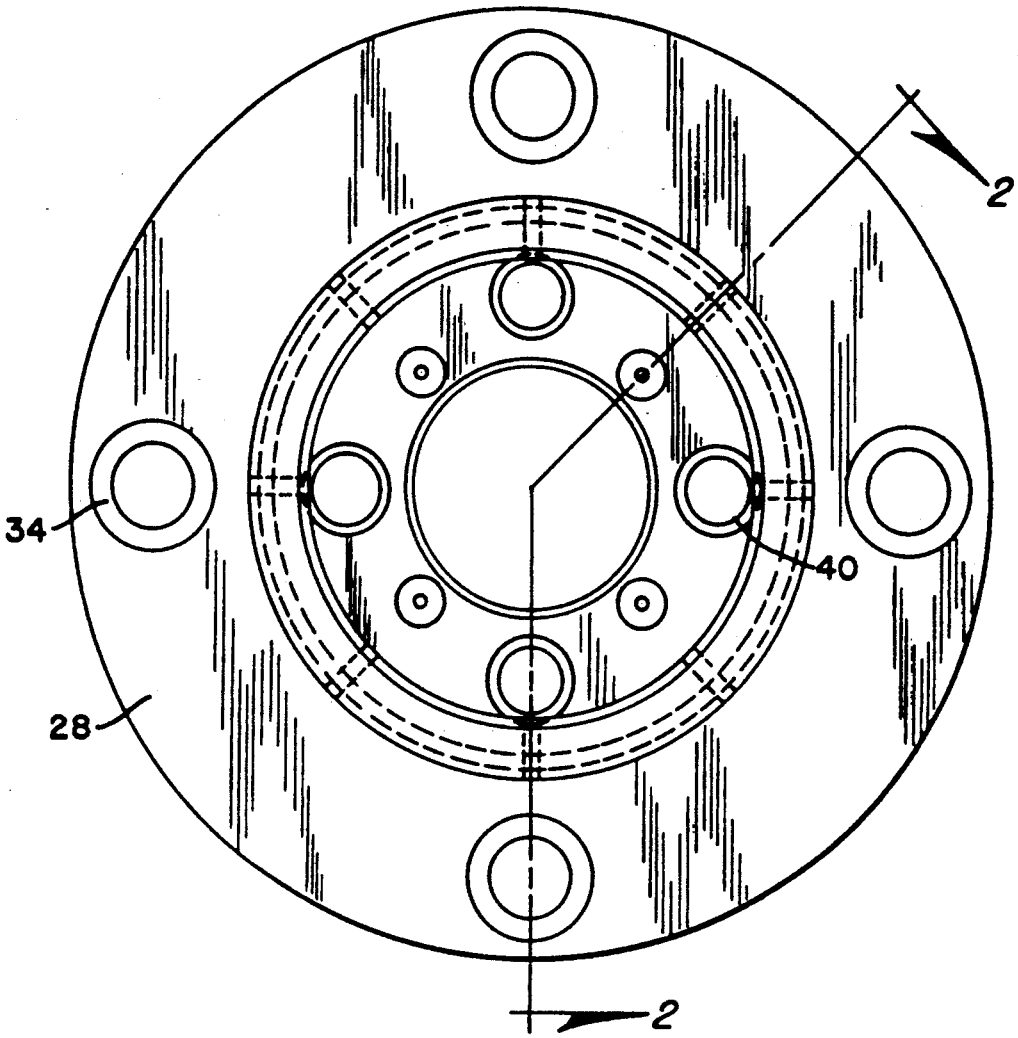
FIG. 1 is an end view of a preferred form of domer apparatus in accordance with the present invention.
Figure 3:
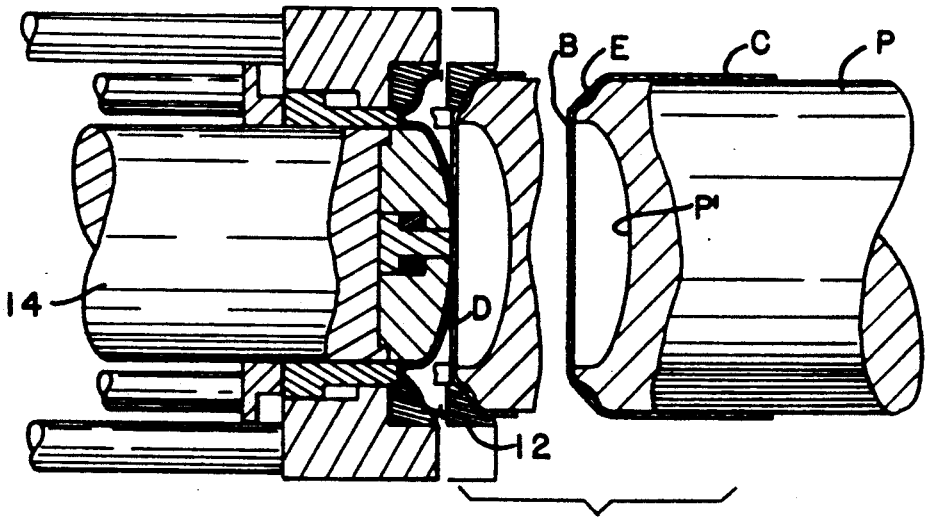
FIG. 3 is a somewhat fragmentary enlarged sectional view illustrating successive stages of the doming operation in accordance with the present invention.
Figure 2:
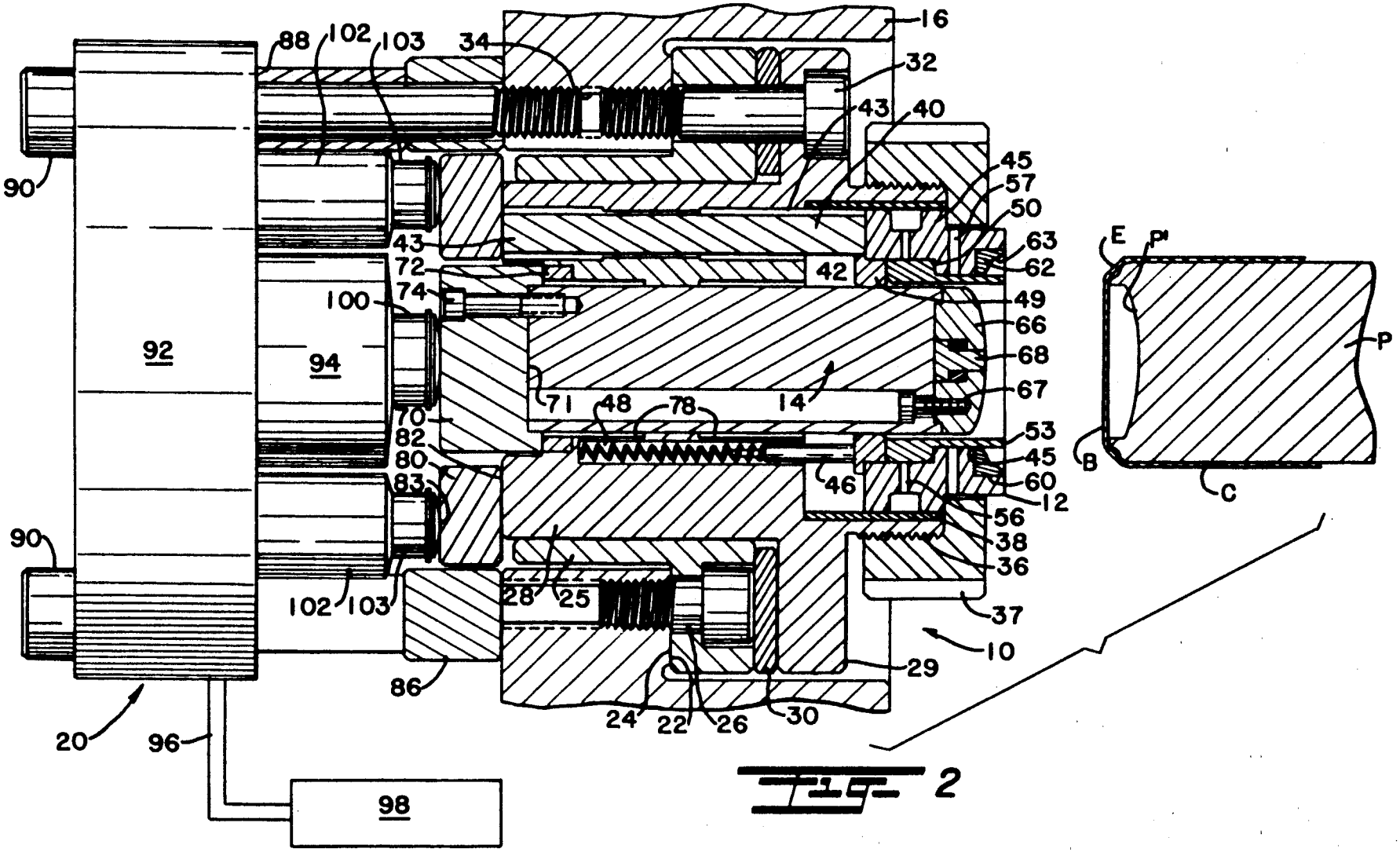
FIG. 2 is a cross-sectional view taken about lines 2—2 of FIG. 1.

Referring in detail to the drawings, there is illustrated in FIGS. 1 and 2 a preferred form of domer assembly 10 for forming the bottom wall B in a metal can blank C. The successive stages of formation are illustrated in FIG. 3 where, in accordance with conventional practice, the metal can blank C is positioned on a punch member P and driven by a ram, not shown, in an axial direction aligned with the center of the domer assembly 10. The bottom wall B of the blank C will move first into engagement with a clamp ring 12 and, as the clamp ring is retracted under the force of the ram, the bottom wall B will then move into engagement with the end of the dome former die or tool 14 and forced into punch cavity P' in forming a center dome D in the bottom wall B of the blank.

In carrying out the doming operation as described, it is important that the resistance to axial movement of the clamp ring 12 and dome forming tool 14 be closely controlled so that the reactive force or resistance to axial sliding movement of the clamp ring is maintained at a selected level necessary for forming the beveled edge E in the bottom wall B, and that the reactive force or resistance across the dome forming tool 14 be at a preset level necessary for forming the dome D to the necessary tolerance and configuration. Although the differential force between the clamp ring 12 and domer tool 14 will vary according to the specific application, for aluminum and steel can bottom forming operations, a pressure on the order of 1700 lbs. should be established and maintained across the clamp ring versus a force of 2200 lbs. per square inch across the domer tool 14. To this end, the domer assembly 10 is mounted on a domer bridge 16 of a standard ironing press, not shown, utilized in metal can forming operations. In order to establish the necessary resistance or reaction forces to movement of the punch P, a fluidized pressure source 20 is independently mounted as a separate unit to one end of the domer assembly 10 opposite to the punch P.

The domer bridge 16 is, in accordance with conventional practice, of annular configuration having an internal shoulder 22 for the purpose of supporting flanged end 24 of an outer housing 25. The flanged end 24 is mounted directly to the internal shoulder 22 by bolts 26 extending through aligned bores in the domer bridge 16 and flanged end 24 and arranged in circumferentially spaced relation around the flanged end 24. The outer sleeve or housing 25 is disposed in surrounding relation to an annular domer housing 28, the latter including a flanged end 29 mounted on the flanged end 24 but separated by an annular spacer element 30. Hold-down bolts 32 are directed through aligned bores in the flanged end portions 29 and 24 as well as a through bore 34 in the domer bridge 16 and are spaced circumferentially and intermediately between the bolts 26. The domer housing 28 includes an externally threaded, axial extension 36 to receive a retainer nut 37 for the clamp ring 12, and an annular bearing 38 is disposed between the clamp ring 12 and axial extension 36.

The clamp ring 12 is mounted for axial slidable movement against a plurality of circumferentially spaced, axially extending, hardened push rods 40, the push rods being slidable through axially extending bores 42 in the domer housing. Axially spaced bearings, not shown, are inserted in recesses 43 between each push rod and surrounding bore 42.

A knock-out ring 45 is disposed in inner concentric relation to the clamp ring 12 and yieldingly supported by spring-loaded knock-out pins 46, each being inserted into a coiled spring 48 so as to be mounted under compression and yieldingly urge the knock-out ring 45 in an axial direction toward the punch P. A push ring 49 is interposed between the ends of the knock-out pins 46 and the clamping ring 45, the knock-out ring 45 having an external shoulder 50 which abuts an internal shoulder on the clamp ring 12, and a reduced extension 53 on the knock-out ring which extends from the shoulder 50 inwardly of and slightly beyond the clamp ring so as to be in the path of travel of the punch P. The clamp ring 12 has an offset portion 55 that forms an external shoulder engaged by the retainer nut 37, and coolant lines 56 and 57 extend radially through the clamp ring 12. The end of the clamp ring facing the punch is notched as at 60 for insertion of a carbide insert 62 having a beveled end surface 63 conforming to the desired configuration of the outer peripheral edge E of the can blank C.

The domer tool 14 is disposed in a central throughbore symmetrically with respect to the longitudinal axis of the entire domer assembly 10. The tool 14 is of conventional construction including a domer shaft 14' of solid, generally cylindrical configuration and having a spherical or convex end portion 66 on one end thereof which is secured by bolts 67 and disposed in facing relation to the punch P. A marking punch 68 is provided in the convex forming end 66 of the tool 14, and a cap shaft 70 which functions as a push plate is affixed to the opposite squared end 71 of the shaft 14'. The push plate or cap shaft 70 is formed with a shallow cavity in its end surface to receive the inner end 71 of the tool 14, and an annular bushing is interposed between the outer surrounding edge of the push plate 70 and the housing 28. Attaching bolts 74 extend upwardly through the push plate 70 and into aligned counterbores in the end of the tool 14 to firmly attach the push plate to the tool 14. Annular bearing members, not shown, are disposed in the axially spaced recesses 78 formed between the domer tool 14 and inner wall of the housing 28.

An annular push plate 80 is disposed in outer concentric relation to the cap shaft 70 to bear against end wall 82 of the domer housing 28. The push plate 80 is of a thickness such that its bottom end surface 83 is substantially aligned with the bottom end surface of the cap shaft 70 prior to or between each doming operation, as illustrated in FIG. 1. An outer spacer ring 86 is positioned in surrounding relation to the push plate 83 and, in combination with a stand-off spacer ring 88, determine the proper spacing between the fluidized pressure source 20 and the push plates 70 and 80. In this relation, the spacer ring 88 will essentially complete the installation of the domer assembly to the domer bridge by insertion of connecting bolts 90 at circumferentially spaced intervals through the spacer ring 86 and stand-off spacer 88 into aligned bores in the domer bridge. In the assembly as shown in FIG. 1, the aligned bores in the domer bridge form continuations of the bores for the outside housing bolts 26.

Now considering in more detail the disposition and relationship of the fluidized pressure source 20 to the balance of the domer assembly, by reference to FIGS. 1 and 2 a preferred form of pressure source includes a nitrogen manifold 92 containing a source of nitrogen under pressure and a return line 96 communicates with a reservoir 98. The manifold 92 communicates with a central cylinder 94 having a piston 100 abutting the exposed end of the cap shaft 70. In addition, the manifold 92 communicates with outer cylinders 102 each having a piston 103 bearing against the push plate 80. The central cylinder 94 and its piston 100 are disposed symmetrically with respect to the longitudinal axis of the assembly. In turn, the outer cylinders 102 and associated pistons 103 are arranged at equally spaced circumferential intervals around the central cylinder to exert a uniform pressure against the push plate 80.

The fluidized pressure source 20 as described is assembled as a self-contained unit to the end of the domer assembly by means of the connecting bolts 90 passing through the manifold but of course isolated from the interior chamber in the manifold. The relative reaction forces established by the pistons 103 with respect to the piston 100 are regulated by the comparative cross-sectional areas of the piston members 100 and 103, since the nitrogen pressure in each cylinder corresponds to that established in the manifold itself. Preferably, however, the reactive forces produced across the pistons 103 are less than that applied across the central piston 100 in order to offer less resistance to movement of the clamp ring than the resistance by piston 100 to movement of the domer tool 14.

From the foregoing, the nitrogen pressure source and specifically the manifold 92 and cylinders 99 and 102 are connected to the domer assembly 10 by means of the connecting bolts 90. The spacer ring 86 in cooperation with the stand-off spacer 88 establishes the basic spacing or clearance between the nitrogen manifold 92 and push plate 70, 80. This is maintained by the connecting bolts 90 and specifically to position the pistons 100, 103 in abutting relation to the push plates 70, 80 at a predetermined reaction force level.

In practice, a metal can blank C is positioned on the drive member or punch P and advanced along the central axis of the domer assembly to cause the annular portion E of the bottom of the can to advance into engagement with the clamp ring insert 62. The knock-out ring 45 will be engaged by the bottom edge of the can in surrounding relation to the cavity P', and the spring-loaded knock-out pin 46 will offer relatively little resistance to movement of the ring 45. However, continued travel of the punch P in forcing the end portion E against the clamp ring insert will be effectively resisted by the outer pistons 103 acting through the push plate 80 and push rods 40. The force of the punch P acting across the clamp ring insert 62 will exceed that of the pistons 103 to cause a limited degree of travel. As illustrated in FIG. 3, this will cause inward pressing of the annual wall portion E to conform to the curvature of the outer peripheral edge of the punch and as a preliminary to movement of the central end portion of the blank C into contact with the domer tool 14.

Continued axial travel or movement of the punch will cause shaping of the center end wall into the configuration of the cavity P' at the end of the punch P under the pressure of the convex end surface 66 of the domer tool 14. As the bottom wall portion is squeezed between the cavity of the punch and the convex end surface 66, the pressure of the piston acting across the face of the cap shaft or push plate 70 will resist continued travel of the punch thereby exerting sufficient pressure causing the metal across the bottom wall of the can blank to be uniformly urged against the wall of the punch cavity P as the ram completes its working stroke and prior to its return for the next doming operation. This overstroking at the end of the working stroke will occur approximately 0.010" to 0.030" before the end of the working stroke.

The independent mounting of the nitrogen pressure source as a self-contained unit greatly facilitates servicing and replacement both of the pressure source and of the domer assembly itself. Specifically, the nitrogen pressure source 20 can be removed without disassembly of any part of the domer assembly 10 with the possible exception of the spacer ring 86 and push plate 80. Any adjustments that have to be made to the domer assembly, such as, to accommodate different length punches P or domer shafts 14 can be carried out by the simple expedient of removing the retainer nut 37, outer bolts 32 and grinding or replacement of the spacer ring 30 between the housings 24 and 28. In this relation, the domer shaft can be easily replaced and the same is true of the clamping ring and push rods with a minimum of disturbance to the entire assembly.

The present invention is readily conformable for use in doming the bottom walls of various can blanks for beverages and other containers and whether composed of aluminum or steel. It is therefore to be understood that various modifications and changes may be made in the construction and arrangement of elements comprising the preferred form of invention without departing from the spirit and scope thereof as defined by the appended claims and reasonable equivalents thereof.

I claim:

1. In apparatus for forming a bottom wall in a metal can body wherein there is provided an outer support, a domer assembly including a dome former die, a clamp ring in outer concentric relation to said die, and means supporting said die and clamp ring for independent axial slidable movement with respect to one another, and a punch member supporting a can body for movement of an end wall of the can body successively against said clamp ring and said former die, the combination therewith comprising:

a fluidized pressure source;

former die cylinder means engageable with said former die support means to yieldingly resist axial slidable movement of said former die;

clamp ring cylinder means disposed in outer surrounding relation to said former die cylinder means to resist axial slidable movement of said clamp ring; and means for mounting said fluidized pressure source, said former die cylinder means and said clamp ring cylinder means as a separate unit independently of mounting of said domer assembly to said outer support.

2. In apparatus according to claim 1, said fluidized pressure source being a source of nitrogen gas under pressure.

3. In apparatus according to claim 1, said former die cylinder means and said clamp ring cylinder means each including piston means extending from said cylinder means into engagement with said former die and said clamp ring support means, respectively.

4. In apparatus according to claim 3, said fluidized pressure source including a common manifold containing nitrogen gas under pressure, said former die cylinder means and said clamp ring cylinder means extending from communication with said common manifold, said piston means for said former die cylinder means and said clamp ring cylinder means being of different selected cross-sectional areas to establish the reactive force applied across each of said respective former die support means and clamp ring support means.

5. In apparatus according to claim 4, the cross-sectional area of said piston means for said former die exceeding that of said piston means for said clamp ring.

6. In apparatus according to claim 1, said mounting means including means for removably attaching said fluidized pressure source to said domer assembly.

7. A doming apparatus adapted for forming a dome and outer beveled edge in a bottom wall of a can body, said apparatus comprising:

a domer assembly having an outer fixed support, a central dome former die axially slidable with respect to said support, a clamp ring including means supporting said clamp ring for independent slidable movement axially with respect to said former die, and spacer means for axially adjusting said former die and said clamp ring with respect to said support;

a punch including drive means supporting a can body for movement of a bottom wall of said can body successively against said clamp ring and said former die; and reaction force-generating means removably attached to said domer assembly including a source of nitrogen gas under pressure, first cylinder means including a piston extending from said first cylinder means to yieldingly resist axial movement of said clamp ring, and second cylinder means including a piston extending from said second cylinder means to yieldingly resist axial movement of said former die.

8. Apparatus according to claim 7, said support defined by a domer bridge, an annular housing and attaching bolts removably attaching said annular housing to said domer bridge.

9. Apparatus according to claim 8, including spacer means between said attaching bolts and said annular housing.

10. Apparatus according to claim 7, said clamp ring support means having axially aligned push rods and a push plate disposed behind said push rods.

11. Apparatus according to claim 7, said first cylinder means exerting a lesser reaction force than said second cylinder means.

12. Apparatus according to claim 7, including means adjustably connecting said reaction force generating means to said domer assembly.

13. Apparatus according to claim 12, including removable attaching means for said reaction force generating means, said attaching means including connecting bolts in spaced circumferential relation to said manifold and said support means and a spacer ring between said manifold and said domer assembly to position said pistons in predetermined relation to said clamp ring and said former die.

14. A doming apparatus adapted for forming a dome and outer beveled edge in a bottom wall of a can body, said apparatus comprising:

a domer assembly having an outer fixed housing, a central dome former die axially slidable with respect to said housing, a clamp ring including means supporting said clamp ring for independent movement axially with respect to said former die, and spacer means for axially adjusting said former die and said clamp ring with respect to said housing, a first push plate at one end of said former die and a second push plate at one end of said clamp ring support means;

a punch including drive means supporting a can body for movement of a bottom wall of said can body successively against said clamp ring and said former die; and reaction force-generating means removably attached to said domer assembly including a source of nitrogen gas under pressure, first cylinder means including a piston extending from said first cylinder means into engagement with said second push plate to yieldingly resist axial movement of said clamp ring, and second cylinder means including a piston extending from said second cylinder means into engagement with said first push plate to yieldingly resist axial movement of said former die.

15. Apparatus according to claim 14, said first and second push plates terminating in substantially coplanar end surfaces for engagement with said pistons of said first and second cylinder means, said piston of said first cylinder means exerting a lesser reaction force against axial movement of said clamp ring than the reaction force exerted by said piston of said second cylinder means.

* * * * *